US005409277A

United States Patent [19]

Rogers, Jr. et al.

[11] Patent Number: 5,409,277

[45] Date of Patent: Apr. 25, 1995

[54] DOOR LOCK ACTUATOR WITH SUPERLOCK FEATURE

[75] Inventors: Lloyd W. Rogers, Jr., Shelby Twp., Utica County; Mark Manuel, Mt. Clemens; Valentin Enache, Troy, all of Mich.

[73] Assignee: General Motors Corporation, Detroit, Mich.

[21] Appl. No.: 25,430

[22] Filed: Mar. 1, 1993

[51] Int. Cl.[6] ..... E05C 3/06; E05B 3/00

[52] U.S. Cl. ..... 292/336.3; 292/201; 292/216; 70/264

[58] Field of Search ..... 292/336.3, 337, 144, 292/201, 216, 280, DIG. 3, DIG. 23, DIG. 43; 70/264

[56] References Cited

U.S. PATENT DOCUMENTS

| | | | |
|---|---|---|---|
| 4,342,209 | 8/1982 | Kleefeldt | 70/264 |
| 4,364,249 | 12/1982 | Kleefeldt | 70/264 |
| 4,440,006 | 4/1984 | Kleefeldt | 70/264 |
| 4,727,301 | 2/1988 | Fulks et al. | 318/468 |
| 4,756,563 | 7/1988 | Garwood et al. | 292/216 |
| 4,805,427 | 2/1989 | Bates et al. | 70/264 |
| 4,806,712 | 2/1989 | Hoffmanne t al. | 200/61 |
| 4,875,723 | 3/1988 | Compeau et al. | 292/201 |
| 4,926,707 | 5/1990 | Yamada | 74/96 |

*Primary Examiner*—Peter M. Cuomo
*Assistant Examiner*—Suzanne L. Dino
*Attorney, Agent, or Firm*—Charles E. Leahy; Jeffrey A. Sedlar

[57] ABSTRACT

A door lock actuator having unlock, lock and superlock modes includes a rotary input member that positions a pivotally mounted output lever in an unlock position, a lock position or a superlock position. The door lock actuator also includes a pivotally mounted superlock lever that has a bypass position and a block position. The rotary input member maintains the superlock lever in the bypass position when the actuator is changed between lock and unlock modes so that the output lever can be moved back and forth between the locked and unlocked positions and moves the superlock lever from the bypass position to the block position when the actuator is changed to a superlock mode so that the superlock lever is moved to the block position to prevent the output lever being moved to the unlock position.

20 Claims, 5 Drawing Sheets

DOOR LOCK ACTUATOR WITH SUPERLOCK FEATURE

BACKGROUND OF THE INVENTION

This invention relates generally to automotive vehicle door locks and more particularly to a door lock actuator that may be used in electrically actuated door locks commonly referred to as power door locks.

Automotive vehicles have a door latch on each vehicle door to latch the door in the closed position. Each vehicle door latch includes a lock that is commonly actuated from inside the vehicle by a readily accessible sill button or other manually operable device on the door. The vehicle door lock for the front doors is conventionally operated from outside the vehicle as well usually by a key lock cylinder that has a removable key to deter theft.

Upscale automotive vehicles commonly employ a power lock system as a convenience feature. The power lock system commonly employs an electrically powered actuator associated with each door latch (and sometimes also with the trunk latch and fuel filler door latch) to move the door lock between its locked and unlocked positions. The actuators are controlled in a variety of ways. In the so called American system, all the actuators are controlled by any one of three switches. These three switches are located in the key lock cylinder for the driver's door and on the interior trim panel for each front door. Thus all doors can be locked or unlocked from outside the vehicle by means of the key lock cylinder switch in the driver's door or from inside the vehicle by means of the switches next to the driver or the front seat passenger.

Manual and power door lock systems have a common problem. As indicated above, the front door locks are commonly actuated from outside the vehicle by a key lock cylinder that has a removable key to deter theft. In four door vehicles, the rear door locks cannot be unlocked from outside the vehicle. However, the door lock for any door is commonly actuated from inside the vehicle by a readily accessible sill button or other manually operable device that does not have any theft deterrent feature. Consequently, the theft deterrent aspect of the key operated door lock can be circumvented by breaking a vehicle window, reaching inside the vehicle and unlocking the vehicle door by means of one of the inside sill buttons or its equivalent.

To overcome this circumvention technique, the superlock feature has been developed as a counter measure in the case of power door lock systems. Briefly this superlock feature is a system that is operated by the key lock cylinder in the driver's door. The superlock system comprises a superlock position in the drivers key lock cylinder, a mechanical block out for the inside sill button or its equivalent in the driver's door and superlock positions in the actuators for the remaining doors that disable the inside sill buttons for these other doors. See for instance U.S. Pat. Nos. 4,342,209; 4,364,249; 4,440,006 and 4,727,301.

One disadvantage of a known superlock system is that it requires sequential operation to insure that all door latches are locked because if one door latch is unlocked by the sill button, the actuator for that door latch does not lock the door latch when it is actuated. Consequently the control switch must always be moved to the unlock position first and then to the lock position to insure that all door latches are locked. Such sequential operation systems are not favored by convenience oriented customers; particularly in North America.

Another disadvantage of another known superlock system is that it requires an extra electric motor in each actuator to engage and disengage the superlock mode. This adds considerable expense to the door lock actuator and the superlock system.

SUMMARY OF THE INVENTION

The object of this invention is to provide a cost effective door lock actuator that includes a superlock position or operating mode that prevents a locked vehicle door from being unlocked by means of the inside sill button or its equivalent.

A feature of the door lock actuator of this invention is that it has a centering spring that eliminates back drive in the locked and unlocked modes and thus reduces key effort.

Another feature of the door latch actuator of this invention is that it takes advantage of a centering spring to engage and disengage a superlock mode.

Another feature of the door latch actuator of this invention is that it does not require an extra electric motor to engage and disengage the superlock mode.

Still another feature of the door latch actuator of this invention is that a centering spring and an electric motor for engaging the lock and unlock modes cooperate to engage and disengage the superlock mode so as to eliminate any need for an extra electric motor to engage or disengage the superlock mode.

Still another feature of the door latch actuator of this invention is that a centering spring and an electric motor for engaging the lock and unlock modes cooperate so that the electric motor can be stalled to change operating modes thereby eliminating any need for a complicated control system to engage or disengage the superlock mode.

Still another feature of the door latch actuator of the invention is that the door latch actuator has a rotary input member that stalls out the electric motor driving it under certain conditions so as to control operation of the door lock actuator as it changes modes of operation.

Still yet another feature of the door latch actuator of the invention is that the door latch actuator has a rotary input member that has a cam path that positions a superlock lever and stalls out the electric motor driving it under certain conditions so as to control operation of the actuator as it changes modes of operation.

Still yet another feature of the door latch actuator of the invention is that the door latch actuator moves the door lock to the locked position every time it is moved to the locked position thereby eliminating any need for sequential operation, i.e. unlocking and then locking all the doors to insure that all doors are locked.

BRIEF DESCRIPTION OF THE DRAWINGS

The above and other objects, features and advantages of the invention will become more apparent from the following description taken in conjunction with the accompanying drawings wherein like references refer to like parts and wherein.

DESCRIPTION OF THE INVENTION

Figure 1:
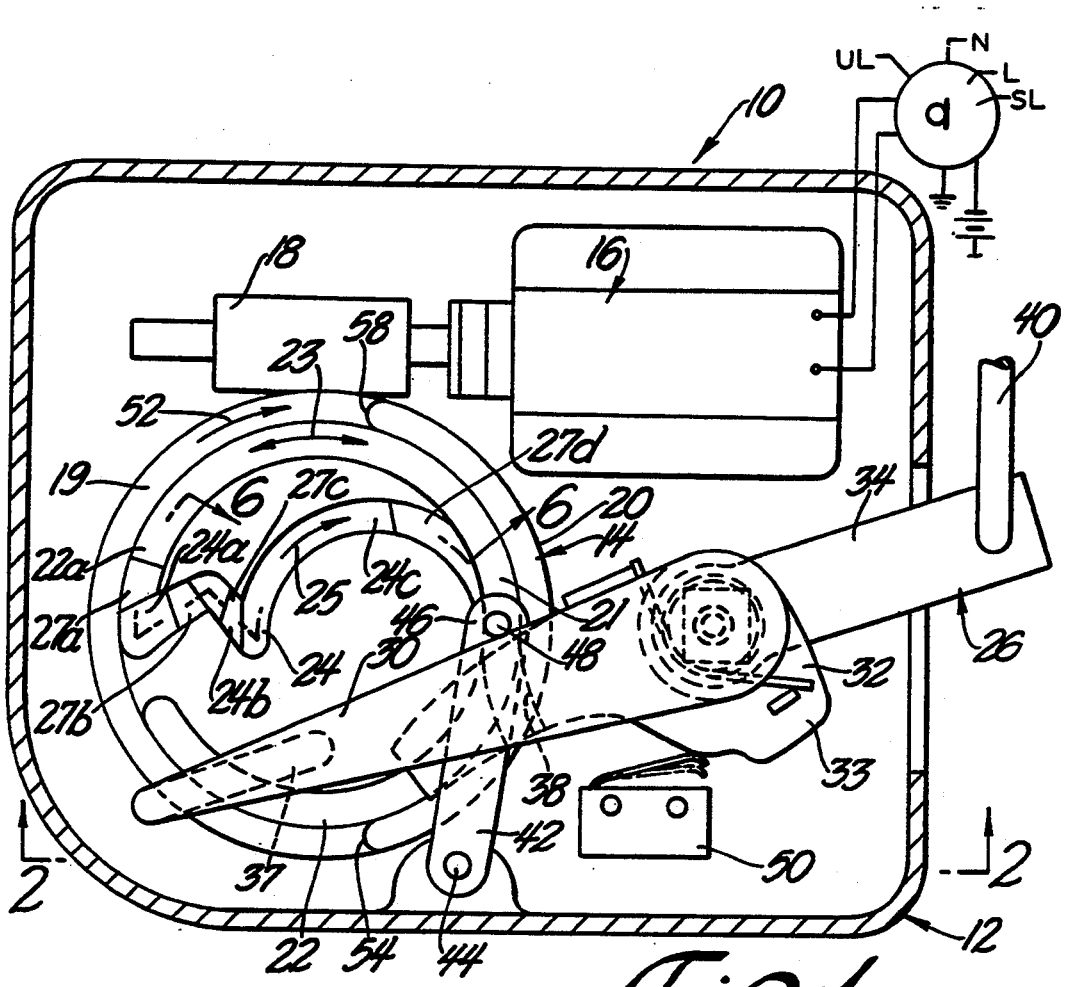
FIG. 1 is a top view of a door lock actuator of the invention showing the actuator in a neutral, unlocked mode.

Referring now to the drawings; and more particularly to FIG. 1, a door latch actuator 10 of the invention comprises a housing 12 that supports a rotary input member 14. The input member 14 is driven by a reversible electric motor 16 through a reversible worm gear 18 that engages a worm wheel 19 integrated into a periphery of the rotary input member 14. The electric motor 16 is controlled by a key switch S that is operated by a key K which turns the key switch S to one of four operative positions—neutral, unlock, lock and superlock. The key switch S is conventionally accessible from outside the vehicle.

The face of the rotary input member 14 has a raised part-circular rib 20 at its outer edge and recessed track 21 inwardly of the rib. The recessed track 21 comprises an outer part-circular path 22 and an inner branch path 24 that forms a loop with an end portion of the part-circular path 22. The part-circular rib 20 and the outer part-circular path 22 of the recessed track 21 are concentric with the pivot axis of the rotary input member 14 and with each other. The outer part-circular path 22 is bidirectional and can be travelled in either direction as indicated by the double headed arrow 23. The inner branch path 24 is unidirectional and can only be travelled in the direction indicated by the arrow 25. The loop formed by the path 24 can only be travelled in this one direction also. This is explained further in the superlock operation description below.

Figure 2:
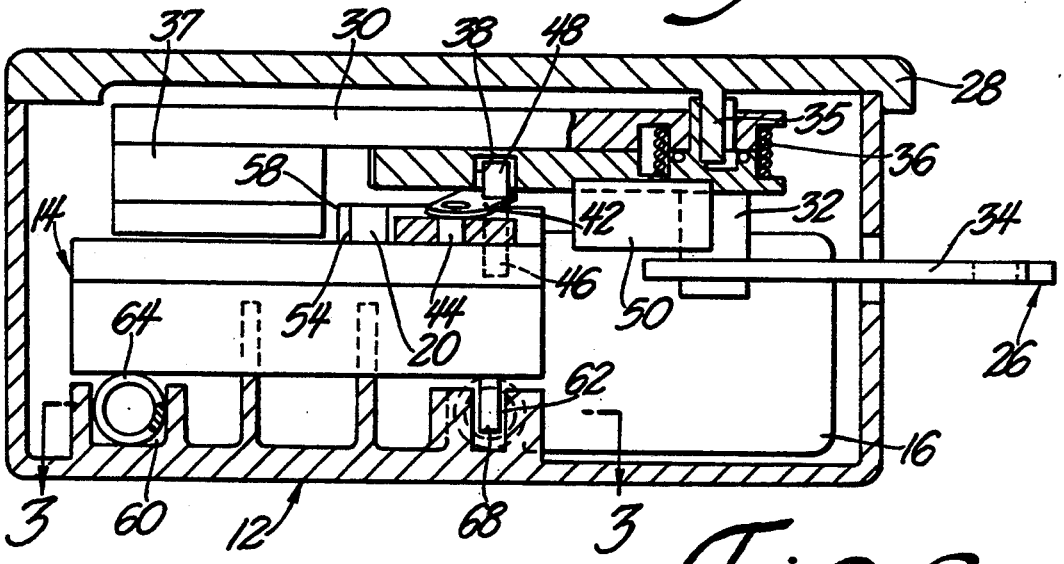
FIG. 2 is a front view taken substantially along the line 2—2 of FIG. 1 looking in the direction of the arrows.

The door latch actuator 10 further comprises a compound output lever 26 that is pivotally mounted on the housing cover 28 as shown in FIG. 2. The output lever 26 has an inner member 30, an intermediate member 32 and an outer member 34. The intermediate member 32 has an integral sleeve that fits in an aperture of the inner member 30 and onto a depending pin 35 of the housing cover 28 cover so that the inner member 30 and the intermediate member 32 both pivot about the pin 35. A torsion spring 36 has opposite end prongs engaging tabs of the inner member 30 and the intermediate member 32 respectively, so that these members move substantially in unison while allowing these members to jack knife a small amount in one direction against the bias of the torsion spring 36. The inner member 30 has a depending tab 37 that is in the path of travel of the part-circular rib 20 when the rotary input member 14 is rotated. The depending tab 37 is engaged by one end or the other of the rib 20 to move the output lever 26 in response to the rotation of the rotary input member 14.

The intermediate member 32 has an arcuate slot 38 that is concentric with the pivot pin 35 for the intermediate member 32. The slot 38 is a bypass slot that allows the output lever 26 to move from one operating position to another under certain circumstances as explained in the operation descriptions below. The intermediate member 32 has a depending square boss that is concentric with the integral sleeve and that is used to attach the outer member 34 so that it moves in unison with the intermediate member 32. The outer end of the outer member 34 is attached to a connection rod 40 that operates a lock mechanism of a door latch (not shown).

The door latch actuator 10 further comprises a superlock lever 42 that is pivotally mounted on a boss of the housing 12 by means of a pivot pin 44 at one end. The opposite end of the superlock lever 42 has a depending, spring biased follower 46 and an upstanding blocker pin 48 that are concentrically arranged with each other. The spring biased follower 46 rides in the depressed track 21 in the face of the rotary input member 14 and the blocker pin 48 cooperates with the intermediate member 32 of the output lever 26 as further explained in the operation description below. The door latch actuator 10 also includes a limit switch 50 that is opened and closed by the intermediate member 32 of the output lever 26. The limit switch 50 is part of a conventional control circuit for the electric motor 16 that includes the key switch S.

Figure 3:
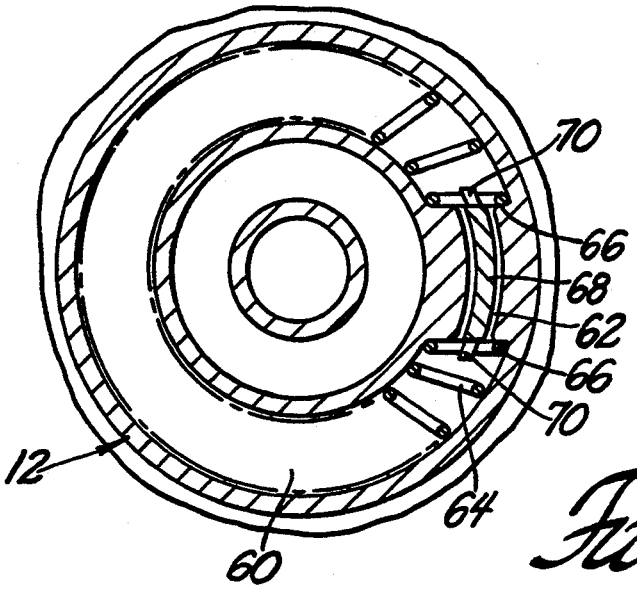
FIG. 3 is a section view taken substantially along the line 3—3 of FIG. 2 looking in the direction of the arrows.

The rotary input member 14 is spring biased to a neutral position that is shown in FIG. 1. The means for biasing the rotary input member 14 into this neutral position is shown in FIG. 3. It comprises a C-shaped groove or track 60 that is formed in the bottom of the housing 12 with its ends connected by a narrower slot 62. A coil compression spring 64 is disposed in the groove 60 so that it is bent into a circular shape with its ends engaging shoulders 66 at each end of the groove 60. The spring 64 is held in the groove 60 by the rotary input member 14. The rotary input member 14 has a depending tongue 68 that is disposed in the slot 62. The tongue 68 is thinner than the slot 62 so that it can move in the circumferential direction. The tongue 68 has tabs 70 at each end that engage the respective ends of the coil spring 64.

As indicated above, the ends of the coil spring 64 engage the shoulders 66 at each end of the groove 60. This centers the rotary input member 14 in the circumferential direction so that the raised rib 20 is in the neutral position that is shown in FIG. 1. When the rotary input member 14 is moved in either circumferential direction by the electric motor 16, the tongue 68 moves one end of the coil spring 64 away from its associated shoulders 66 and compresses the coil spring 64. The coil spring 64 then centers the rotary input member 14 and returns the rib 20 to the neutral position when the electric motor 16 is shut off.

LOCK AND UNLOCK OPERATION

The door lock actuator 10 is shown in the neutral, unlocked mode in FIGS. 1, 2 and 3. In this condition, the rotary input member 14 is in its neutral position, the output lever 26 is in its unlocked position and the superlock lever 42 is in its by-pass position.

The door latch actuator 10 is changed to the locked mode by inserting key K in key switch S and turning key K from the neutral position to the lock position.

The change occurs in two stages—an electrical power stage and a spring return stage. First the electric motor 16 is energized when the key K is turned to the lock position in the key switch S. This turns the motor 16 in one direction and rotates the rotary input member 14 clockwise as indicated by the arrow 52 from the neutral position of FIG. 1 until the shoulder 54 at one end of the rib 20 engages the tab 37 of the inner member 30 and moves the output lever 26 to the locked position shown in solid line in FIG. 4. In this position a cam portion 33 of the intermediate member 32 opens the limit switch 50 and cuts power to the electric motor 16. When the electric power is shut off, the return spring 64 rotates the rotary input member 14 counterclockwise back to the neutral position as shown in phantom in FIG. 4 and in solid line in FIG. 1. The output lever 26 stays in the locked position shown in FIG. 4 by virtue of a conventional over center device or the like in the locking mechanism of the door latch (not shown).

As the rotary input member 14 rotates clockwise under the power of the electric motor 16 and returns counterclockwise under the action of the return spring 64, the follower 46 travels back and forth in the outer part-circular path 22 of the recessed track 21. This maintains the superlock lever 44 in its bypass position during the locking procedure. In the bypass position, the blocking pin 48 is aligned with the bypass slot 38 of the intermediate member 32 and the blocking pin 48 passes through the by-pass slot 38 as the output lever 26 pivots from its unlocked position shown in FIG. 1 to its locked position shown in FIG. 4.

The door latch actuator 10 is also changed back to the unlocked mode in an electrical power stage and a spring return stage. First the electric motor 16 is energized by turning key K to an unlock position in key switch S. This reverses polarity and turns the motor 16 in the opposition direction. This rotates the rotary input member 14 counterclockwise as indicated by the arrow 56 from the neutral position shown in phantom in FIG. 4 until the shoulder 58 at the opposite end of the rib 20 engages the tab 37 of the inner member 30 and moves the output lever 26 to the unlocked position shown in FIG. 5 where the follower 46 bottoms against the end of the path 22. This stalls the electric motor 16. When the power is shut off, the return spring 64 rotates the rotary input member 14 clockwise back to the neutral position shown in FIG. 1. The output lever 26 stays in the unlocked position shown in FIG. 4 by virtue of a conventional over center device or the like as indicated above.

Figure 4:
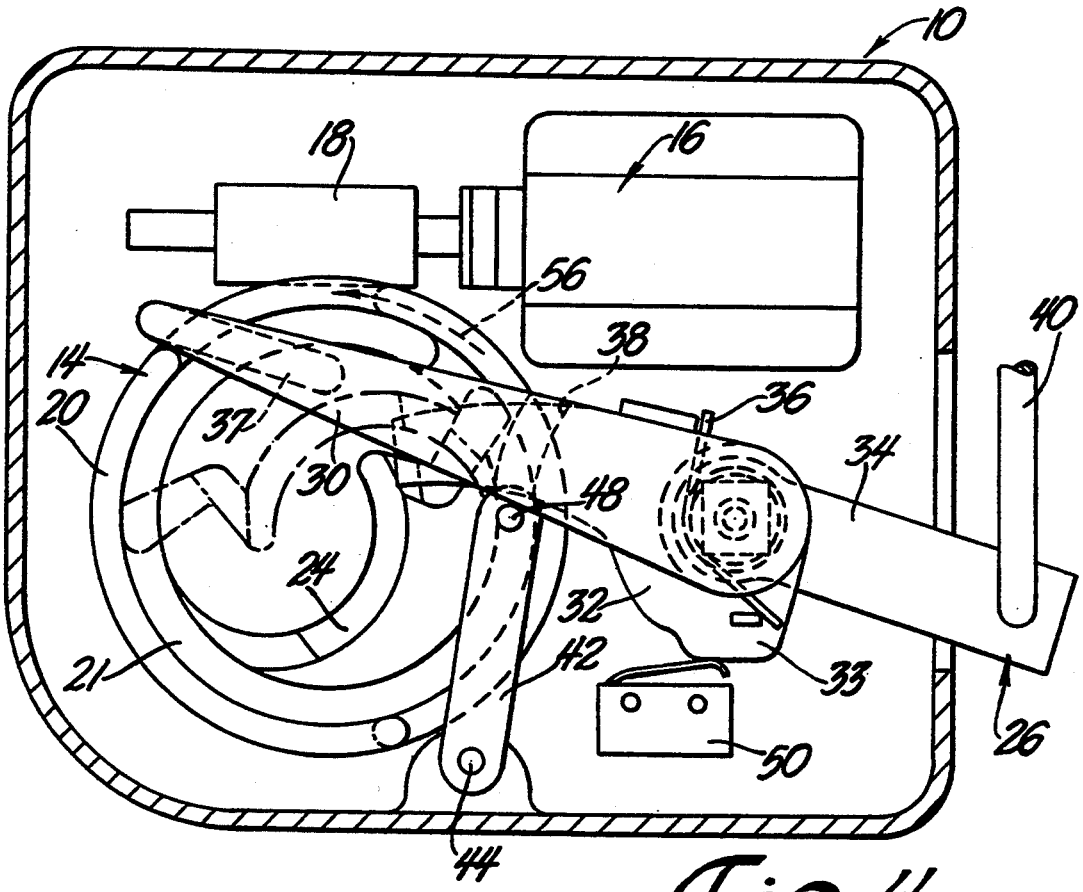
FIG. 4 is a top view of the door lock actuator of the invention showing the actuator in initial and final stages of a locked mode.
Figure 5:
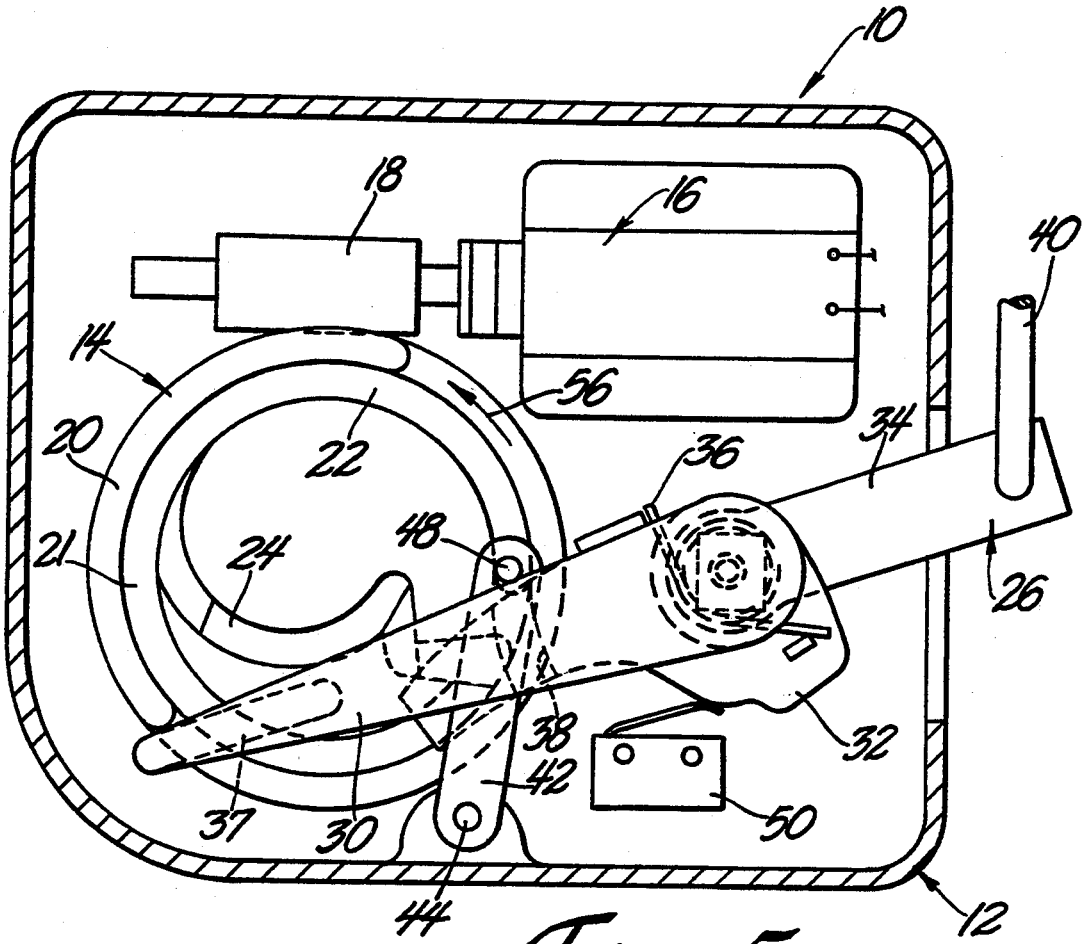
FIG. 5 is a top view of the door lock actuator of the invention showing the actuator in an initial stage of the unlocked mode.

As the rotary input member 14 rotates counterclockwise under the power of the electric motor 16 and returns clockwise under the action of the return spring 64, the follower 46 again travels back and forth in the part-circular path 22 of the track 21 maintaining the superlock lever 44 in its bypass position so that the blocking pin 48 passes through the by-pass slot 38 as the output lever 26 pivots from its locked position shown in FIG. 4 back to its unlocked position shown in FIGS. 1 and 5.

The door lock actuator 10 can also be changed back and forth between the locked and unlocked mode from inside a vehicle by pivoting the output lever 26 with a conventional sill button or the like that is operatively connected to the connection rod 40.

However, the door latch actuator 10 has a superlock feature that requires key operation to change back to the unlocked mode. This is a vehicle security feature that prevents unauthorized entry by breaking the vehicle door window and unlocking the vehicle door by operating the inside sill button or its equivalent. As indicated above, the door latch actuator 10 with the superlock feature is normally used only on the passenger doors and controlled by the key lock cylinder switch S associated with the driver's door. The door latch on the drivers door preferably uses a mechanical superlock that can be disengaged by the key K so that the driver's door can be opened in the event of a power failure.

SUPERLOCK OPERATION

The door latch actuator 10 moves the superlock lever 42 from its by-pass position shown in FIGS. 1, 4 and 5 to a blocking position when the superlock feature is engaged and back to its by-pass position when the superlock feature is disengaged. The superlock lever 42 is moved back and forth between the blocking position and the bypass position by the follower 46 travelling part of the loop of the recessed track 21 of the rotary input member 14.

Figure 6:
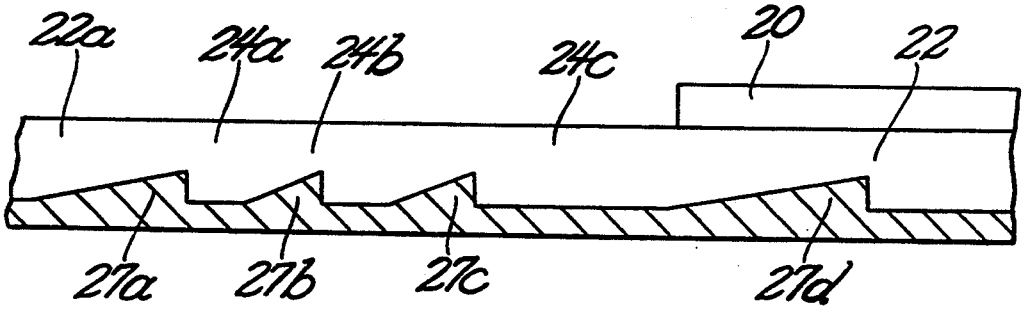
FIG. 6 is a section taking substantially along the line 6—6 of FIG. 1 showing the profile of an inner branch path of a recessed track in the rotary input member of the door lock actuator.

This loop which is best shown in FIG. 1 comprises the inner branch path 24 and an "overtravel" portion **22*a* that leads into the inner branch path 24. The inner branch path 24 has three legs; a spring back engagement leg 24*a*, a power disengagement leg 24*b* and a spring back disengagement leg 24*c*. As indicated earlier, these portions of the recessed track 21 are unidirectional, that is the follower 46 can only travel through the overtravel portion 22*a* and the inner branch path 24 in one direction as indicated by the arrow 25 in FIG. 1. This unidirectional travel limitation is accomplished by four cam steps 27*a*, 27*b*, 27*c* and 27*d* which are best shown in the profile of FIG. 6**.

Figure 7:
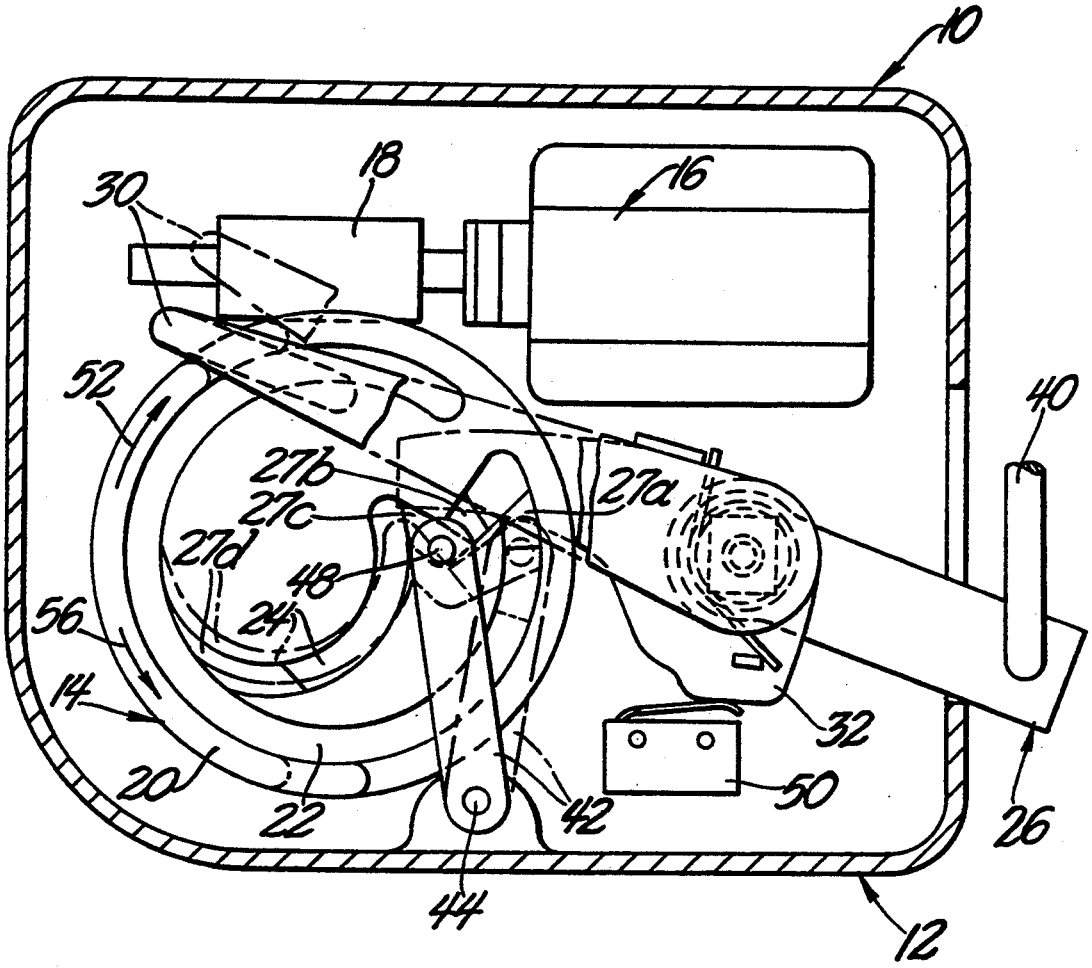
FIG. 7 is a top view of the door lock actuator of the invention showing the actuator in initial and final stages of a superlock mode.

The door latch actuator 10 is also changed to the superlocked mode in two stages—an electrical power stage and a spring return stage. First the electric motor 16 is actuated by turning key K to the superlock position in key switch S. This turns the motor in the first or lock direction, overrides the limit switch 50 and rotates the rotary input member 14 clockwise from the neutral position of FIG. 1 as indicated by the arrow 52. The shoulder 54 at the end of the rib 20 eventually engages the tab 37 of the inner member 30 and then moves the output lever 26 to the locked position shown in solid line in FIG. 4. The rotary input member 14 continues clockwise rotation because the limit switch 50 has been overridden so that the follower 46 moves through the overtravel portion **22*a* of the track 21 and falls off the end of the cam step 27*a* where it engages the end of the path 22 as shown in phantom in FIG. 7**.

This stops rotation of the rotary input member 14 and stalls the electric motor 16 which cuts off electrical power to the motor 16. During this power stage, the output lever 26 jack knifes a small amount against the bias of torsion spring 38. When the power is shut off, the return spring 64 rotates the rotary input member 14 counterclockwise back toward the neutral position which is shown in phantom in FIG. 4 and in solid line in FIG. 1. As the rotary member 14 rotates counterclockwise, the raised end of the cam step **27*a* keeps the follower 46 out of the particular path 22, guides the follower 46 into first leg 24*a* of the inner branch path 24. The follower 46 then moves through the leg 24*a* and falls off the end of cam step 27*b* where it engages the end of the leg 24*a* as shown in solid line in FIG. 7. This locks up the rotary input member 14 against any further movement by the return spring 64 in the counterclockwise direction. The superlock lever 44 and the output lever 26 are now both in the superlock position shown in solid line in FIG. 7. The superlock position of the output lever 26 corresponds to the locked position shown in FIG. 4 more or less and the output lever 26 is held in this position by the conventional over center device of the door latch (not shown). But more importantly, the output lever 26 is also locked in the superlock position by the lock pin 48 which is now located in a blocking relationship with intermediate member 32. In other words, the door latch actuator 10 cannot be changed back to the unlocked mode from inside the vehicle because the output lever 26 cannot be pivoted counterclockwise from the solid line position shown in FIG. 7**.

The door latch actuator 10 is taken out of the superlock position solely by turning the key K to the lock position in the key switch S. The electric motor 16 then rotates the rotary input member 14 clockwise as indicated by the arrow 52 from the superlock position shown in FIG. 7 until the follower 46 travels through leg **24*b* of the inner branch path 24, falls off the end of the cam step 27*c* and engages the end of the leg 24*b* to stop rotation of the rotary input member in the clockwise direction as shown in solid line in FIG. 8. This stalls the electric motor 16**.

During this initial or power stage of the superlock disengagement procedure, the inner member 30 of the compound output lever 26 is moved in the clockwise direction a small amount. This causes a small jack knife movement that is accommodated by the torsion spring 36 while the outer member 34 is held in the superlock position by door latch (not shown).

Figure 8:
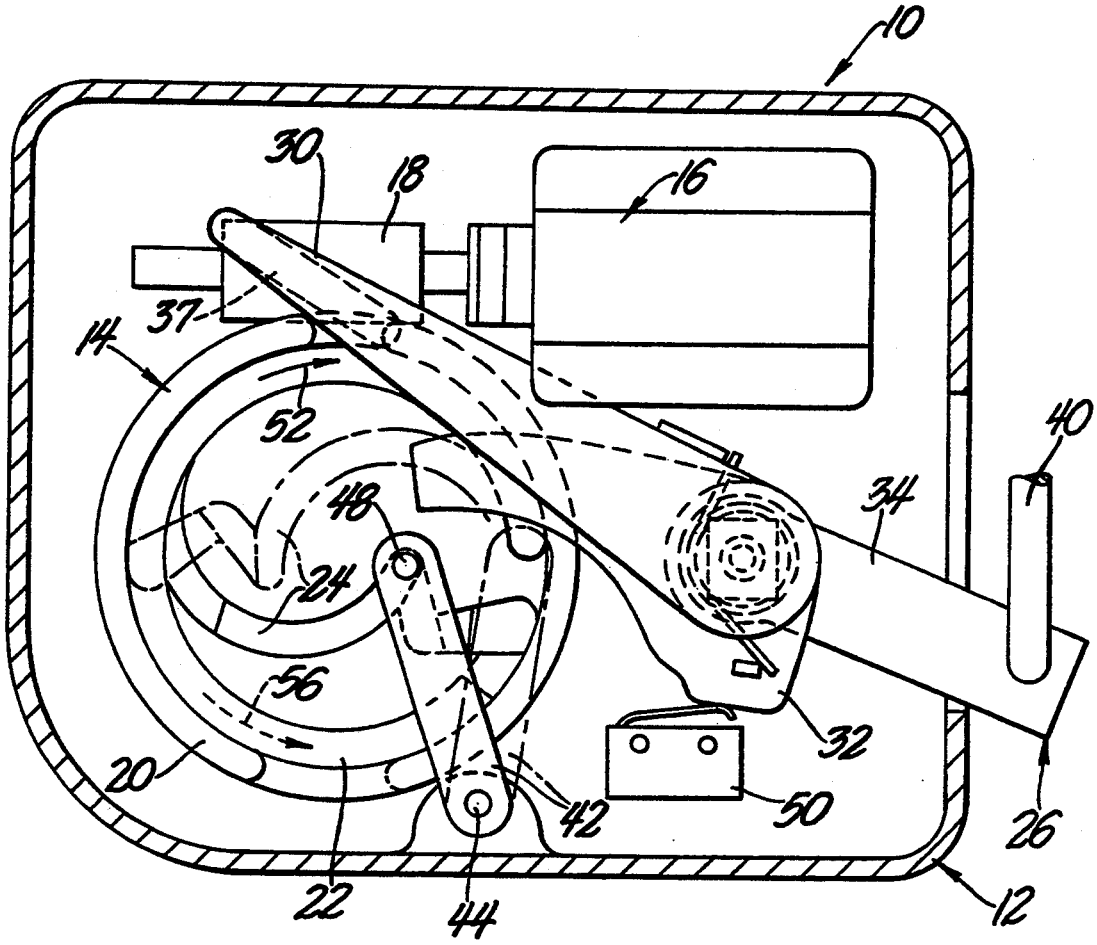
FIG. 8 is a top view of the door lock actuator of the invention showing the actuator in an initial stage of being disengaged from the superlock mode.

After the motor 16 stalls out, the rotary input member 14 is rotated counterclockwise as indicated by the arrow 56 in FIG. 8 under the bias of the return spring 64 until the rotary input member 14 returns to the neutral position as shown in phantom in FIG. 8. During this spring return stage of the superlock disengagement procedure, the cam follower 46 travels through the last leg **24*c* of the inner branch 24, falls off the end of the cam step 27*d* at the end of the spring return leg 24*c* and reenters the part-circular path 22. This moves the superlock lever 44 back to the bypass position so that the door lock actuator is now in the locked mode which is also shown in phantom in FIG. 4**.

The door lock actuator 10 can now be changed to the unlocked mode from either inside or outside the vehicle. Inside by pivoting the output lever 26 via rod 40 and outside by turning key K to the unlocked position in key switch S. This initiates the same power unlock procedure described above.

The invention has been described in an illustrative manner, and it is to be understood that the terminology which has been used is intended to be in the nature of words of description rather than of limitation.

Obviously, many modifications and variations of the present invention in light of the above teachings may be made. It is, therefore, to be understood that, within the scope of the appended claims, the invention may be practiced otherwise than as specifically described.

The embodiments of the invention in which an exclusive property or privilege is claimed are defined as follows:

1. A door lock actuator comprising;

a rotary input member having first and second circumferentially spaced shoulders, a pivotally mounted output lever that has an unlock position, a lock position and a superlock position, the pivotally mounted output lever having a portion that is engaged by the first and second shoulders for moving the pivotally mounted output lever from one position to another, a pivotally mounted superlock lever that has a bypass position and a block position, wherein the rotary input member, the pivotally mounted output lever and the pivotally mounted superlock lever provide the door lock actuator with an unlock, a lock and a superlock mode and the rotary input member having means engaging the pivotally mounted superlock lever for maintaining the superlock lever in the bypass position when the actuator is changed between lock and unlock modes so that the output lever can be moved back and forth between the locked and unlocked positions and for moving the superlock lever from the bypass position to the block position when the actuator is changed to a superlock mode so that the superlock lever is moved to the block position to prevent the output lever being moved to the unlock position.

2. The door latch actuator as defined in claim 1 wherein the means engaging the pivotally mounted superlock lever comprises a track in the rotary input member and a follower attached to the superlock lever.

3. The door latch operator as defined in claim 2 wherein the track has an outer part circular path and an inner branch path that forms a loop with an end portion of the outer part circular path.

4. The door latch actuator as defined in claim 3 wherein the output lever is a compound lever that can jackknife a small amount in one direction.

5. A door lock actuator having unlock, lock and superlock modes comprising;

a rotary input member having first and second circumferentially spaced shoulders, a pivotally mounted output lever that has an unlock position, a lock position and a superlock position, the pivotally mounted output lever having a tab that is engaged by the first and second shoulders for moving the pivotally mounted output lever from one position to another, a pivotally mounted superlock lever that has a bypass position and a block position, the rotary input member having a track and the pivotally mounted superlock lever having a follower that is disposed in the track of the rotary input member for locating the pivotally mounted superlock lever in one position or the other, the track having a bidirectional portion that maintains the superlock lever in the bypass position and a unidirectional portion that moves the superlock lever back and forth between the bypass position and the block position, the follower of the pivotally mounted superlock lever being disposed in the bidirectional portion when the actuator is changed between lock and unlock modes so that the superlock lever is maintained in the bypass position whereby the output lever can be moved back and forth between the locked and unlocked positions, and the follower of the pivotally mounted superlock lever being disposed in the unidirectional portion of the track when the actuator is changed to a superlock mode so that the superlock lever is moved to the block position to prevent the output lever being moved to the unlock position.

6. The door latch actuator as defined in claim 5 further comprising;

spring means for centering the rotary input member and motor means for moving the rotary input member against the bias of the spring means.

7. The door latch actuator as defined in claim 5 further comprising;

spring means for centering the rotary input member in a neutral position and an electric motor for moving the rotary input member in one direction against the bias of the spring means for moving the output lever to the locked position and for moving the rotary input member in an opposite direction against the bias of the spring means for moving the output lever to the unlocked position.

8. The door latch operator as defined in claim 7 wherein the electric motor moves the rotary input member in the one direction and the spring means moves the rotary input member in the opposite direction for moving the superlock lever to the block position.

9. The door latch operator as defined in claim 8 wherein the electric motor moves the rotary input member in the one direction and the spring means moves the rotary input member in the opposite direction for moving the superlock lever to the bypass position.

10. The door latch actuator as defined in claim 5 wherein the output lever is a compound lever that can jackknife a small amount in one direction.

11. The door latch actuator as defined in claim 9 wherein the output lever is a compound lever that can jackknife a small amount in one direction.

12. A door lock actuator having unlock, lock and superlock modes comprising;

a rotary input member having an arcuate rib that has a first shoulder at one end and a second shoulder at an opposite end, a pivotally mounted compound output lever that has an unlock position, a lock position and a superlock position, the pivotally mounted output lever having a depending tab that is engaged by the first and second shoulders of the arcuate rib for moving the pivotally mounted output lever from one position to another, a pivotally mounted superlock lever that has a bypass position and a block position, the rotary input member having a track and the pivotally mounted superlock lever having a follower that is disposed in the track of the rotary input member for locating the pivotally mounted superlock lever in one position or the other, the track having a bidirectional portion that maintains the superlock lever in the bypass position and a unidirectional portion that moves the superlock lever back and forth between the bypass position and the block position, the follower of the pivotally mounted superlock lever being disposed in the bidirectional portion when the actuator is changed between lock and unlock modes so that the superlock lever is in the bypass position whereby the output lever can be moved back and forth between the locked and unlocked positions, and the follower of the pivotally mounted superlock lever being disposed in the unidirectional portion of the track when the actuator is changed to a superlock mode so that the superlock lever is moved to the block position to prevent the output lever being moved to the unlock position.

13. The actuator as defined in claim 12 wherein the unidirectional portion of the track has a surface that includes a series of cam steps and the follower is spring biased into engagement with the surface that includes the series of cam steps.

14. The actuator as defined in claim 13 wherein the track has a part circular path that provides the bidirectional portion of the track is a part circular path and the unidirectional portion of the trace comprises an inner branch path that forms a loop with an end portion of the part circular path.

15. The door latch actuator as defined in claim 13 further comprising;

spring means for centering the rotary input member in a neutral position and an electric motor for moving the rotary input member in one direction against the bias of the spring means for moving the output lever to the locked position and for moving the rotary input member in an opposite direction against the bias of the spring means for moving the output lever to the unlocked position.

16. The door latch operator as defined in claim 14 wherein the electric motor moves the rotary input member in the one direction and the spring means moves the rotary input member in the opposite direction for moving the superlock lever to the block position.

17. The door latch operator as defined in claim 16 wherein the electric motor moves the rotary input member in the one direction and the spring means moves the rotary input member in the opposite direction for moving the superlock lever to the bypass position.

18. The door latch actuator as defined in claim 17 wherein the output lever is a compound lever that can jackknife a small amount in one direction.

19. The door latch operator as defined in claim 14 wherein the electric motor moves the rotary input member in the one direction and the :spring means moves the rotary input member in the opposite direction for moving the superlock lever back and forth between the bypass and the block positions.

20. The door latch actuator as defined in claim 19 wherein the output lever is a compound lever that can jackknife a small amount in one direction.

* * * * *